US007175294B1

(12) United States Patent
Estrada et al.

(10) Patent No.: US 7,175,294 B1
(45) Date of Patent: Feb. 13, 2007

(54) INSULATED AND LUMINESCENT DRINKING VESSEL

(76) Inventors: Raymond M. Estrada, 1802 Clark Ave., Long Beach, CA (US) 90815; Sa'd Ball, 1802 Clark Ave., Long Beach, CA (US) 90815

( * ) Notice: Subject to any disclaimer, the term of this patent is extended or adjusted under 35 U.S.C. 154(b) by 195 days.

(21) Appl. No.: 10/891,249

(22) Filed: Jul. 14, 2004

(51) Int. Cl.
*F21V 33/00* (2006.01)

(52) U.S. Cl. ..... 362/101; 362/96; 362/154

(58) Field of Classification Search ..... 362/96, 362/101, 154, 253
See application file for complete search history.

(56) References Cited

U.S. PATENT DOCUMENTS 5,743,620 A 4/1998 Rojas et al.
6,186,637 B1 2/2001 Murrietta
6,254,247 B1 * 7/2001 Carson ..... 362/101
6,352,352 B1 3/2002 Schletterer et al.
6,499,854 B2 * 12/2002 Chen ..... 362/101
6,511,196 B1 * 1/2003 Hoy ..... 362/101
6,520,657 B1 2/2003 DeNicola
2003/0076672 A1 * 4/2003 Head ..... 362/101
2003/0076673 A1 4/2003 Diak/Ghanem
2005/0207141 A1 * 9/2005 Boesch et al. ..... 362/101

* cited by examiner

*Primary Examiner*—John Anthony Ward

(57) ABSTRACT

An insulated and luminescent drinking vessel for use as a safety device by walkers, joggers and bikers having a transparent tubular outer vessel having a top side and a bottom side. A lamp is connectable to the outer vessel bottom side. A conical inner vessel is connected to the outer vessel top side, the lamp is for illuminating the inner vessel.

19 Claims, 4 Drawing Sheets

INSULATED AND LUMINESCENT DRINKING VESSEL

BACKGROUND OF THE INVENTION

1. Field of the Invention

The present embodiment of the invention relates to an insulated and luminescent drinking vessel for use in connection with drinking vessels. The insulated and luminescent drinking vessel has particular utility in connection with an insulated and illuminated drinking vessel having a conical inner container.

2. Description of the Prior Art

Insulated and luminescent drinking vessels are desirable for use by walkers, joggers or cycler's for use as a safety enhancement device at night. Additionally it is a decorative alternative to water bottles and would provide an inventive novelty that could be sold at amusement parks and zoos. A need was felt for an insulated and luminescent drinking vessel that would have a conical inner container that would be completely illuminated by the lamp in the base.

The use of drinking vessels is known in the prior art. For example, U.S. Pat. No. 6,186,637 to Murietta discloses a baby bottle with light and sound amusement features that has a hollow cylindrical body and a bladder that holds the feeding liquid. The device is adapted to frictionally fit into an open end of the cylinder opposite a feeding nipple. The device projects light beams into the liquid filled bladder and also produces a sound show. The device projects a single or multiple light beams that change color, shape, intensity, and blink synchronously with time. The light and sound show entertain the baby while it is feeding and may also pacify and arouse the baby. However, the Murietta '637 patent does not have a rigid conical inner container for efficiently dispersing light from the bottom of the container.

Similarly, U.S. Pat. No. 6,520,657 to DeNicola discloses a chemiluminescent illuminating base assembly is provided to enhance to consumers the appeal of products sold in containers and for those means and/or devices to be simple, cost effective, and incorporate interaction between consumer and product. The assembly comprises a product container having a bottom surface and at least one side surface; a chemiluminescent illuminating base comprising an illuminating base portion substantially supporting the product container and having a top wall at least partially opposed to the bottom surface of the product container; a bottom wall capable of transmitting an engaging pressure; a chemiluminescent illuminating device disposed between the top and bottom walls and operative by the application of the engaging pressure; and at least one substantially upright wall connecting the top and bottom walls, and enclosing the chemiluminescent illuminating device; and being secured at the top wall of the illuminating base portion to the bottom surface of the product container. The methods of manufacture for same are also provided. However, the DeNicola '657 patent does not have a rigid conical inner container for efficiently dispersing light from the bottom of the container.

Likewise, U.S. Pat. No. 6,352,352 to Schletterer et al. discloses a luminescent container with quick-charging power source, such as a drinking glass, drinking cup, a vase, or a bottle, is illuminated with an LED. The power for the LED is supplied by quick-charging capacitors which are integrated in a cavity of the container together with the LED. The LED is disposed in a wedge-shaped recess which effects advantageous distribution of the light through the obliquely inclined walls. The capacitors are typically charged within a matter of seconds and they have a virtually unlimited cycle life. However, the Schletterer et al. '352 patent does not have a rigid conical inner container for efficiently dispersing light from the bottom of the container.

Correspondingly, U.S. Pat. No. 6,254,247 to Carson discloses an illuminable containers and method comprises a first compartment for sealably containing a beverage and a second compartment adjacent the first compartment. A barrier having a translucent portion separates the first and second compartments. A light source and an energy source electrically connected to the light source are disposed in the second compartment. A switch activates the light source such that the light source shines through the translucent portion of the barrier and illuminates the beverage disposed in the first compartment of the container. A holographic image embedded in a film attached to an outside of the container is created within the first compartment when the light source is illuminated. Methods are also provided. However, the Carson '247 patent does not have a rigid conical inner container for efficiently dispersing light from the bottom of the container.

Further, United States Patent Application Publication 2003/0076673 to Diak/Ghanem discloses An Insulated and luminescent drinking vessel with an insulated wall structure including an inner wall, an outer wall, and a void between the inner and outer walls providing an insulative barrier for maintaining the temperature of the liquid contents within a desired range for extended periods of time, while also preventing the formation of condensation on the outside of the vessel. Luminescent elements, such as shapes, letters, numbers or designs, are applied to the insulated wall structure to enhance visibility of the drinking vessel and the level of liquid beverage contents when in dark or low light conditions. In an alternative embodiment, the luminescent material is incorporated into the composition of the wall structure during the molding process. A removable lid may be provided for covering the open top of the drinking vessel. In one embodiment, the drinking vessel and removable top lid are structured and disposed to provide a child's sip cup, wherein the lid includes an integrated sip spout and valve for resisting spills. However, the Diak/Ghanem '673 patent application does not have a rigid conical inner container for efficiently dispersing light from the bottom of the container.

Lastly, U.S. Pat. No. 5,743,620 to Rojas et al. discloses a body worn lighted drinking receptacle designed to be suspended from the belt of a user by a belt clip unit. The drinking receptacle includes a generally translucent receptacle member having an illumination source operatively associated with its bottom portion, and an opaque upper portion which blocks the transmission of light from the illumination source. However, the Rojas et al. '620 patent does not have a rigid conical inner container for efficiently dispersing light from the bottom of the container.

While the above-described devices fulfill their respective, particular objectives and requirements, the aforementioned patents do not describe an insulated and luminescent drinking vessel that allows an insulated and illuminated drinking vessel having a conical inner container. The Murietta '637, DeNicola '657, Schletterer et al. '352, Carson '247, Diak/Ghanem '673 and Rojas et al. '620 patents make no provision for a rigid conical inner container for efficiently dispersing light from the bottom of the container.

Therefore, a need exists for a new and improved insulated and luminescent drinking vessel which can be used for an insulated and illuminated drinking vessel having a conical inner container. In this regard, the present embodiment of the invention substantially fulfills this need. In this respect, the insulated and luminescent drinking vessel according to the present embodiment of the invention substantially departs from the conventional concepts and designs of the prior art, and in doing so provides an apparatus primarily developed for the purpose of an insulated and illuminated drinking vessel having a conical inner container.

SUMMARY OF THE INVENTION

In view of the foregoing disadvantages inherent in the known types of drinking vessels now present in the prior art, the present embodiment of the invention provides an improved insulated and luminescent drinking vessel, and overcomes the above-mentioned disadvantages and drawbacks of the prior art. As such, the general purpose of the present embodiment of the invention, which will be described subsequently in greater detail, is to provide a new and improved insulated and luminescent drinking vessel and method which has all the advantages of the prior art mentioned heretofore and many novel features that result in an insulated and luminescent drinking vessel which is not anticipated, rendered obvious, suggested, or even implied by the prior art, either alone or in any combination thereof.

To attain this, the present embodiment of the invention essentially comprises a transparent tubular outer vessel having a top side and a bottom side. A lamp is connectable to the outer vessel bottom side. A conical inner vessel is connected to the outer vessel top side, the lamp is for illuminating the inner vessel.

There has thus been outlined, rather broadly, the more important features of the embodiment of the invention in order that the detailed description thereof that follows may be better understood and in order that the present contribution to the art may be better appreciated.

The present embodiment of the invention may also include a lid, a base, a reflector, a power switch and a power connection. There are, of course, additional features of the present embodiment of the invention that will be described hereinafter and which will form the subject matter of the claims attached.

Numerous objects, features and advantages of the present embodiment of the invention will be readily apparent to those of ordinary skill in the art upon a reading of the following detailed description of presently preferred, but nonetheless illustrative, embodiments of the present embodiment of the invention when taken in conjunction with the accompanying drawings. In this respect, before explaining the current embodiment of the embodiment of the invention in detail, it is to be understood that the embodiment of the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present embodiment of the invention.

It is therefore an object of the present embodiment of the invention to provide a new and improved insulated and luminescent drinking vessel that has all of the advantages of the prior art drinking vessels and none of the disadvantages.

It is another object of the present embodiment of the invention to provide a new and improved insulated and luminescent drinking vessel that may be easily and efficiently manufactured and marketed.

An even further object of the present embodiment of the invention is to provide a new and improved insulated and luminescent drinking vessel that has a low cost of manufacture with regard to both materials and labor, and which accordingly is then susceptible of low prices of sale to the consuming public, thereby making such insulated and luminescent drinking vessel economically available to the buying public.

Still another object of the present embodiment of the invention is to provide a new insulated and luminescent drinking vessel that provides in the apparatuses and methods of the prior art some of the advantages thereof, while simultaneously overcoming some of the disadvantages normally associated therewith.

Lastly, an object of the present embodiment of the invention is to provide an insulated and luminescent drinking vessel for an insulated and illuminated drinking vessel having a conical inner container.

These together with other objects of the embodiment of the invention, along with the various features of novelty that characterize the embodiment of the invention, are pointed out with particularity in the claims annexed to and forming a part of this disclosure. For a better understanding of the embodiment of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The embodiment of the invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
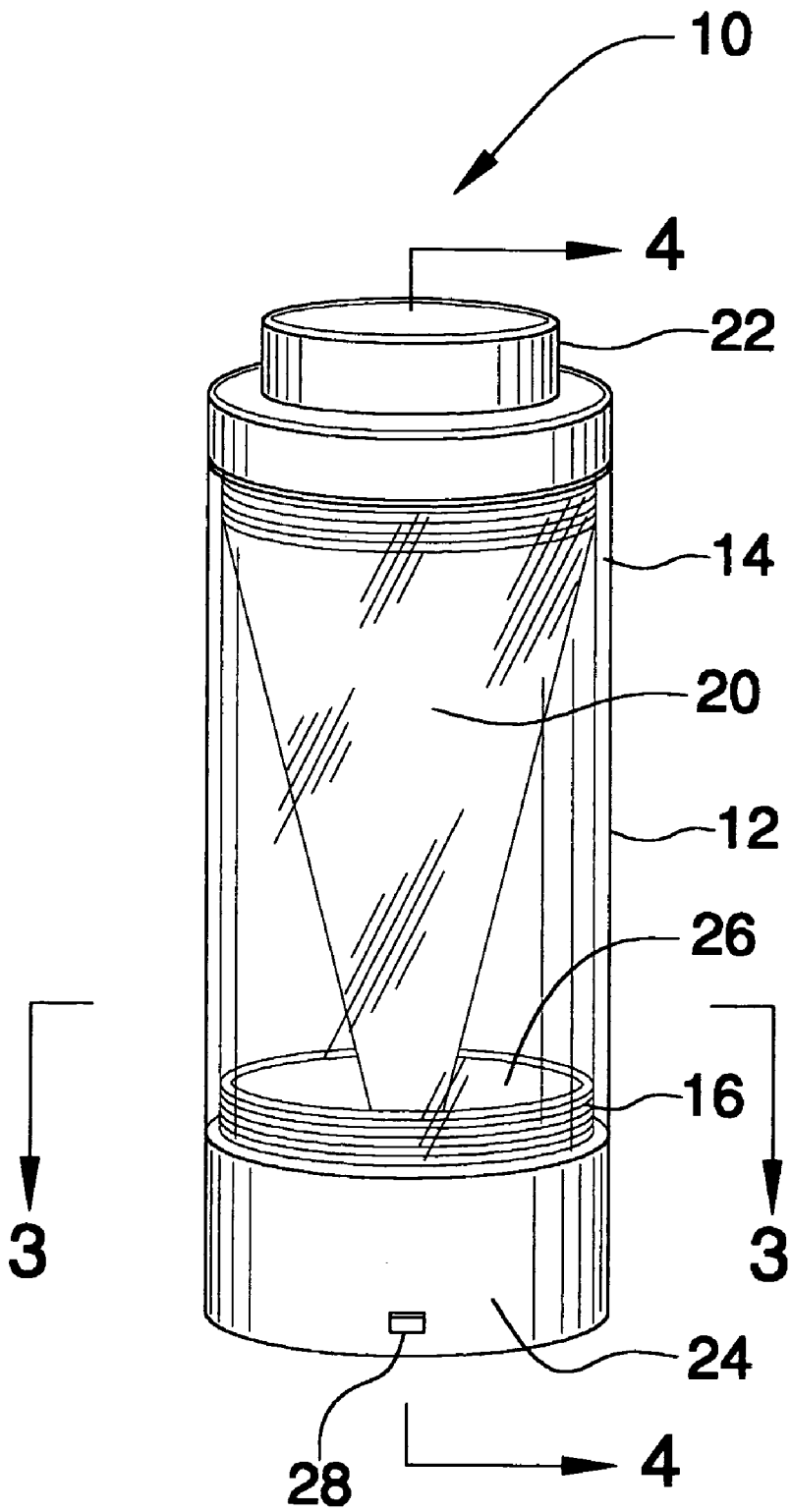
FIG. 1 is a top perspective view of the preferred embodiment of the insulated and luminescent drinking vessel constructed in accordance with the principles of the present invention.

Referring now to the drawings, and particularly to FIGS. 1–4, a preferred embodiment of the insulated and luminescent drinking vessel of the present invention is shown and generally designated by the reference numeral 10.

In FIG. 1, a new and improved insulated and luminescent drinking vessel 10 of the present invention for an insulated and illuminated drinking vessel having a conical inner container is illustrated and will be described. More particularly, the insulated and luminescent drinking vessel 10 has a transparent tubular outer vessel 12 having a top side 14 and a bottom side 16. A lamp 18 (shown in FIG. 4) is connectable to the outer vessel bottom side 16. In the present embodiment the lamp is a filament bulb, in other embodiments the lamp may be a light emitting diode. A transparent conical inner vessel 20 is connected to the outer vessel top side 14. In other embodiments the inner vessel 20 may be translucent. It is critical that the inner vessel be conical in shape to allow light to be maximally reflected from the inner vessel 20. The lamp 18 is for illuminating the inner vessel 20. A threaded lid 22 is detachably connectable to the outer vessel top side 14. The threaded lid 22 to the outer vessel top side 14 detachable connection is water tight. A threaded base 24 is detachably connected to the outer vessel bottom side 14. The lamp 18 is connected to the base 24. A reflector 26 (shown in FIG. 4) is connected to the base 24. A power switch 28 is connected to the base 24.

Figure 2:
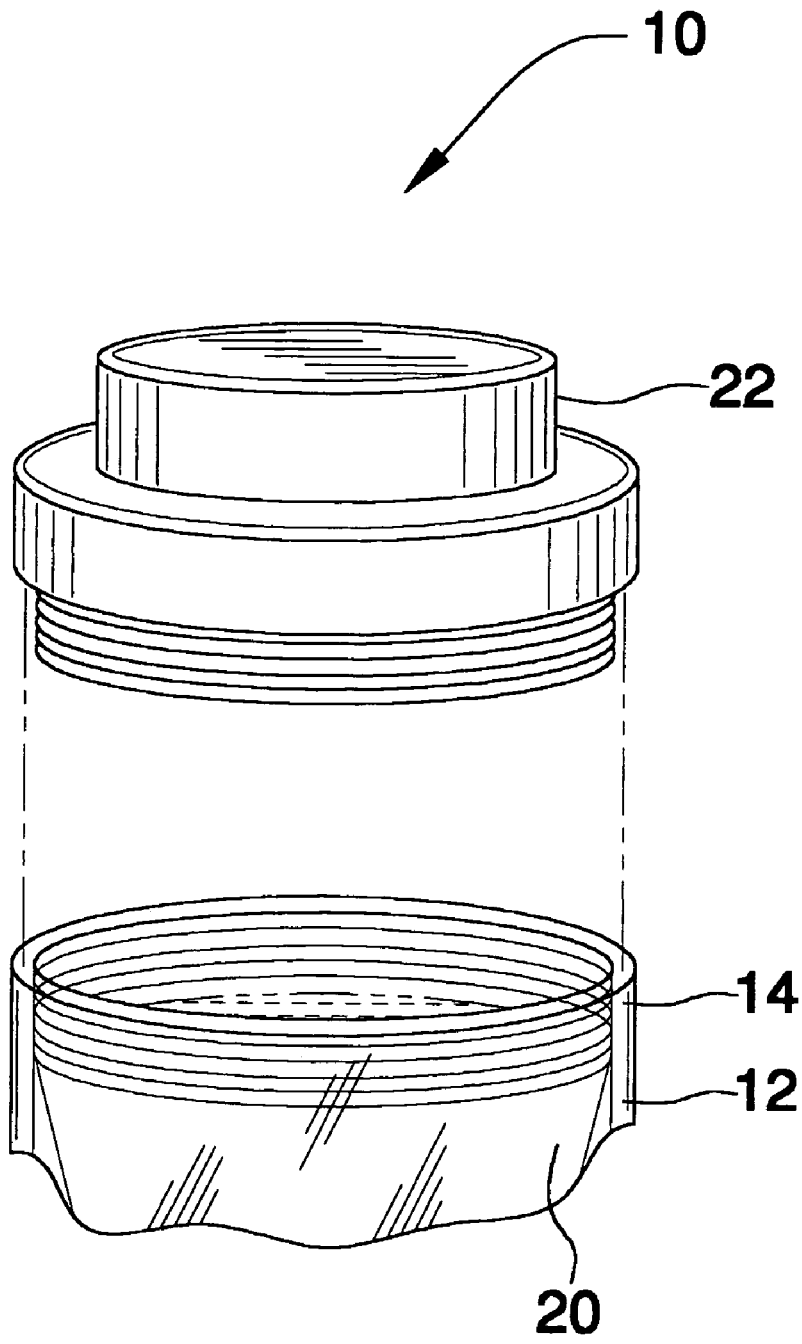
FIG. 2 is a top perspective view of the insulated and luminescent drinking vessel of the present embodiment of the invention.

In FIG. 2, the insulated and luminescent drinking vessel 10 is illustrated and will be described. More particularly, the insulated and luminescent drinking vessel 10 has the transparent tubular outer vessel 12 having the top side 14. The transparent conical inner vessel 20 is connected to the outer vessel top side 14. The threaded lid 22 is detachably connectable to the outer vessel top side 14. The threaded lid 22 to the outer vessel top side 14 detachable connection is water tight.

Figure 3:
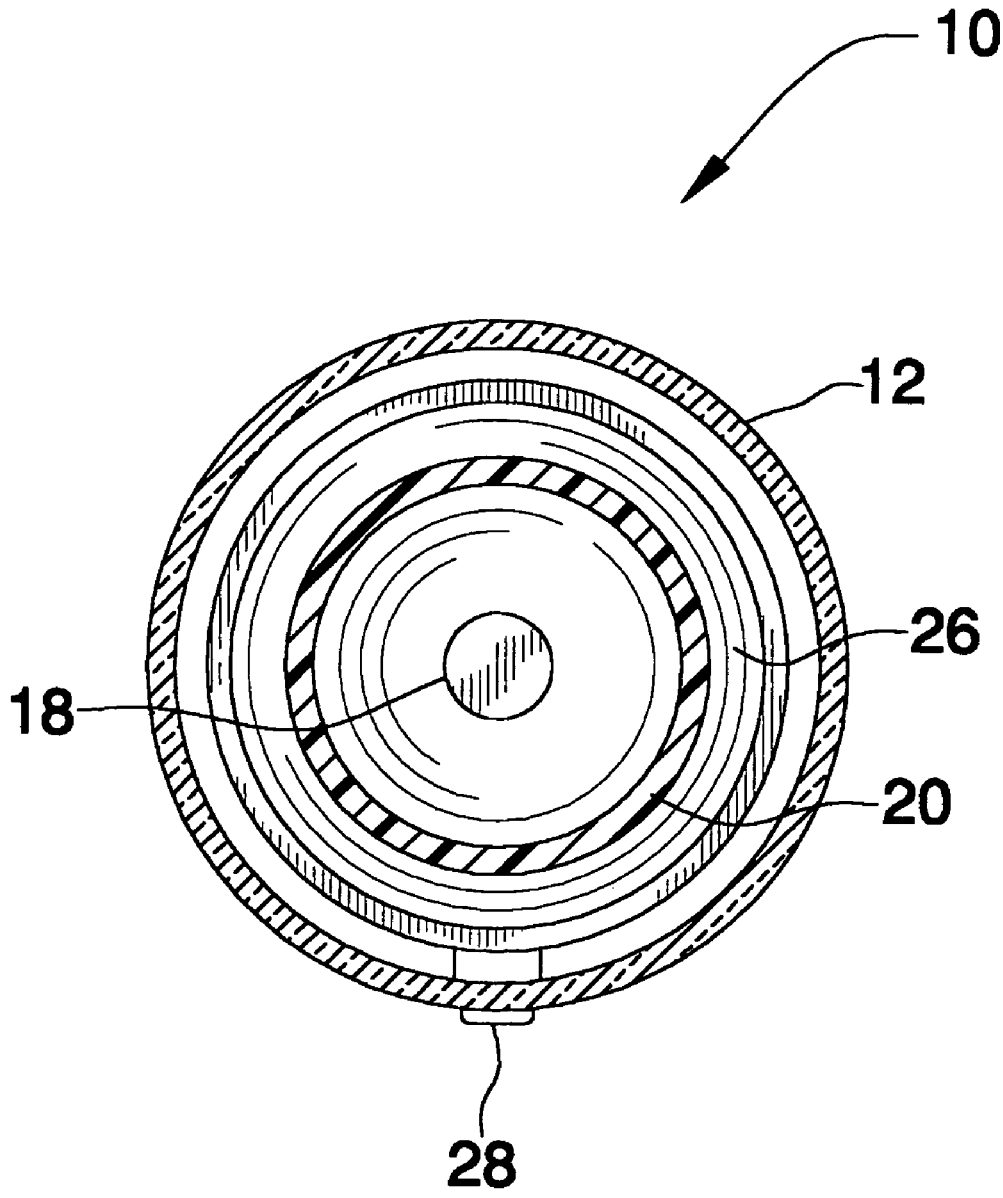
FIG. 3 is a section 3—3 view of FIG. 1 of the insulated and luminescent drinking vessel of the present embodiment of the invention.

In FIG. 3, the insulated and luminescent drinking vessel 10 is illustrated and will be described. More particularly, the insulated and luminescent drinking vessel 10 has the transparent tubular outer vessel 12. The lamp 18 is connectable to the outer vessel bottom side 16. The transparent conical inner vessel 20 is connected to the outer vessel top side 14. The lamp 18 is for illuminating the inner vessel 20. The lamp 18 is connected to the base 24 (shown in FIG. 4). The reflector 26 is connected to the base 24. The power switch 28 is connected to the base 24.

Figure 4:
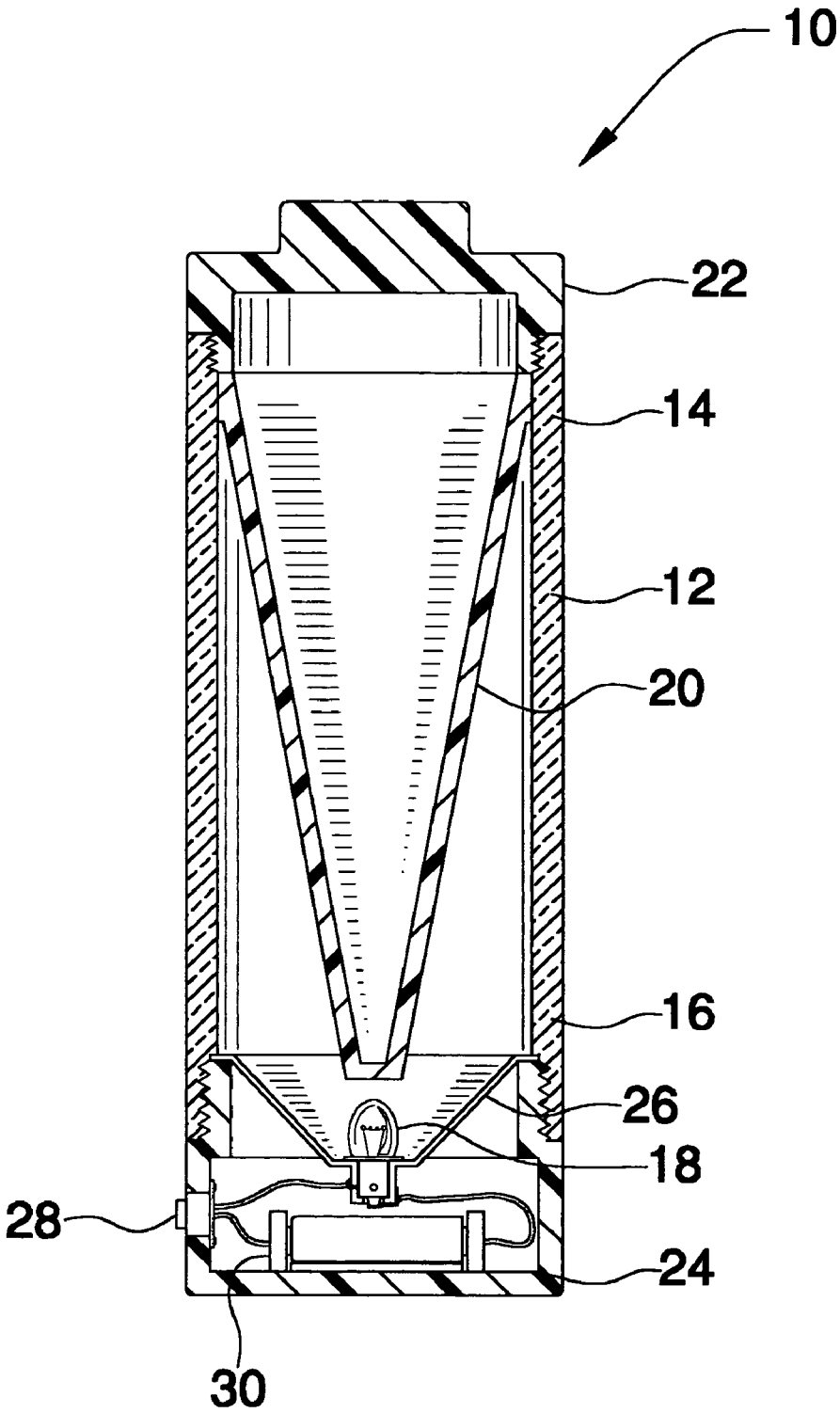
FIG. 4 is a section 4—4 view of FIG. 1 of the insulated and luminescent drinking vessel of the present embodiment of the invention.

In FIG. 4, the insulated and luminescent drinking vessel 10 is illustrated and will be described. More particularly, the insulated and luminescent drinking vessel 10 has the transparent tubular outer vessel 12 having the top side 14 and the bottom side 16. The lamp 18 is connectable to the outer vessel bottom side 16. In the present embodiment the lamp is a filament bulb, in other embodiments the lamp may be a light emitting diode. The transparent conical inner vessel 20 is connected to the outer vessel top side 14. In other embodiments the inner vessel 20 may be translucent. It is critical that the inner vessel be conical in shape to allow light to be maximally reflected from the inner vessel 20. The lamp 18 is for illuminating the inner vessel 20. The threaded lid 22 is detachably connectable to the outer vessel top side 14. The threaded lid 22 to the outer vessel top side 14 detachable connection is water tight. The threaded base 24 is detachably connected to the outer vessel bottom side 14. The lamp 18 is connected to the base 24. The reflector 26 is connected to the base 24. The power switch 28 is connected to the base 24. A power connection 30 is connected to the base 24.

In use, it can now be understood that batteries are placed in connection with the power connection 30 and the power switch 28 is turned on illuminating the conical inner vessel 20.

While a preferred embodiment of the insulated and luminescent drinking vessel has been described in detail, it should be apparent that modifications and variations thereto are possible, all of which fall within the true spirit and scope of the invention. For example, although a luminescent vessel has been described, a translucent or reflective surface would also capture the spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present embodiment of the invention. For example, any suitable light source such as light emitting diode may be used instead of the filament lamp described. And although an insulated and illuminated drinking vessel having a conical inner container have been described, it should be appreciated that the insulated and luminescent drinking vessel herein described is also suitable for providing a lantern.

Therefore, the foregoing is considered as illustrative only of the principles of the embodiment of the invention. Further, since numerous modifications and changes will readily occur to those skilled in the art, it is not desired to limit the embodiment of the invention to the exact construction and operation shown and described, and accordingly, all suitable modifications and equivalents may be resorted to, falling within the scope of the embodiment of the invention.

We claim:

1. An insulated and luminescent drinking vessel comprising:

a transparent tubular outer vessel, said outer vessel having a top side, said outer vessel having a bottom side;

a lamp connectable to said outer vessel bottom side; and a conical inner vessel comprising a frustum enclosed by said outer vessel and connected to said outer vessel top side, said lamp emits light to illuminate said inner vessel, wherein at least a portion of said light emitted by said lamp is cast directly upon said inner vessel and wherein the majority of said light is reflected by said inner vessel.

2. The insulated and luminescent drinking vessel of claim 1 wherein:

said inner vessel is comprised of transparent material.

3. The insulated and luminescent drinking vessel of claim 1 further comprising:

a threaded lid detachably connectable to said outer vessel top side.

4. The insulated and luminescent drinking vessel of claim 3 wherein:

said threaded lid to said outer vessel top side detachable connection is water tight.

5. The insulated and luminescent drinking vessel of claim 1 further comprising:

a threaded base detachably connected to said outer vessel bottom side.

6. The insulated and luminescent drinking vessel of claim 5 further comprising:

a reflector connected to said base.

7. The insulated and luminescent drinking vessel of claim 5 further comprising:

a power switch connected to said base.

8. The insulated and luminescent drinking vessel of claim 5 further comprising:

a power connection connected to said base.

9. The insulated and luminescent drinking vessel of claim 5 wherein:

said lamp is connected to said base.

10. The insulated and luminescent drinking vessel of claim 1 wherein:

said conical inner vessel is comprised of translucent material.

11. An insulated and luminescent drinking vessel comprising:

a transparent tubular outer vessel, said outer vessel having a top side, said outer vessel having a bottom side;

a lamp connectable to said outer vessel bottom side; and a transparent conical inner vessel comprising a frustum enclosed by said outer vessel and connected to said outer vessel top side, said lamp emits light to illuminate said inner vessel, wherein at least a portion of said light emitted by said lamp is cast directly upon said inner vessel and wherein the majority of said light is reflected by said inner vessel.

12. The insulated and luminescent drinking vessel of claim 11 further comprising:

a threaded lid detachably connectable to said outer vessel top side.

13. The insulated and luminescent drinking vessel of claim 12 wherein:

said threaded lid to said outer vessel top side detachable connection is water tight.

14. The insulated and luminescent drinking vessel of claim 13 further comprising:

a threaded base detachably connected to said outer vessel bottom side.

15. The insulated and luminescent drinking vessel of claim 14 further comprising:

a reflector connected to said base.

16. The insulated and luminescent drinking vessel of claim 15 further comprising:

a power switch connected to said base.

17. The insulated and luminescent drinking vessel of claim 16 further comprising:

a power connection connected to said base.

18. The insulated and luminescent drinking vessel of claim 17 wherein:

said lamp is connected to said base.

19. An insulated and luminescent drinking vessel comprising:

a transparent tubular outer vessel, said outer vessel having a top side, said outer vessel having a bottom side;

a lamp connectable to said outer vessel bottom side;

a transparent conical inner vessel comprising a frustum enclosed by said outer vessel and connected to said outer vessel top side, said lamp emits light illuminate said inner vessel, wherein at least a portion of said light emitted by said lamp is cast directly upon said inner vessel and wherein the majority of said light is reflected by said inner vessel;

a threaded lid detachably connectable to said outer vessel top side, said threaded lid to said outer vessel top side detachable connection is water tight;

a threaded base detachably connected to said outer vessel bottom side, said lamp is connected to said base;

a reflector connected to said base;

a power switch connected to said base; and a power connection connected to said base.

* * * * *